United States Patent [19]

Perret

[11] 4,129,473

[45] Dec. 12, 1978

[54] APPARATUS FOR THE AUTOMATIC LABELLING OF OBJECTS OF DIFFERING SHAPES

[76] Inventor: Jean Y. Perret, Domaine de Soulancé, Martres-Tolosane, Haute-Garonne, France

[21] Appl. No.: 726,615

[22] Filed: Sep. 27, 1976

[30] Foreign Application Priority Data

Oct. 3, 1975 [FR] France ..... 75 30320

[51] Int. Cl.[2] ..... B65C 3/00; B65C 9/42

[52] U.S. Cl. ..... 156/364; 156/361; 156/542; 156/556; 156/DIG. 5; 156/DIG. 19; 156/DIG. 33

[58] Field of Search ..... 156/540, 541, 542, DIG. 5, 156/DIG. 19, DIG. 33, DIG. 25–DIG. 26, DIG. 40–DIG. 41, DIG. 39, 475, 488, 489, 486, 30, 361, 493, 363, 364, 556; 101/38 A, 40; 193/35 B, 37

[56] References Cited

U.S. PATENT DOCUMENTS

| | | | |
|---|---|---|---|
| 2,169,226 | 8/1939 | Cormack | 156/DIG. 5 |
| 2,641,377 | 6/1953 | Zander | 156/556 |
| 2,804,961 | 9/1957 | Carter | 156/DIG. 27 |
| 3,247,044 | 4/1966 | Pechmann | 156/DIG. 13 |
| 3,530,025 | 9/1970 | Achterberg | 156/360 |
| 3,709,755 | 1/1973 | Wochner | 156/542 |
| 3,944,455 | 3/1976 | French | 156/542 |

FOREIGN PATENT DOCUMENTS

| | | |
|---|---|---|
| 2436324 | 4/1975 | Fed. Rep. of Germany. |
| 2167124 | 8/1973 | France. |
| 833685 | 4/1960 | United Kingdom. |

*Primary Examiner*—William A. Powell
*Assistant Examiner*—Michael W. Ball
*Attorney, Agent, or Firm*—Cooper, Dunham, Clark, Griffin & Moran

[57] ABSTRACT

Apparatus for the automatic labelling of objects of differing shapes, which comprises a first guide means, a second guide means in spaced, opposed relationship to the first guide means, means, for example, a conveyor belt, for advancing objects between the said first and second guide means, pressure contact means provided on at least one of the said first and second guide means operative to urge an object passing between the said first and second guide means against the other said second or first guide means, respectively, and means for transferring an image, by a pressure-transfer operation, to an object passing between the said first and second guide means. The apparatus is especially applicable to the labelling of pieces of fruit, preferably using self-adhesive pressure-transferable labels which are pressed onto the fruit, or other object, by the pressure-contact means as it passes between the first and second guide means.

6 Claims, 1 Drawing Figure

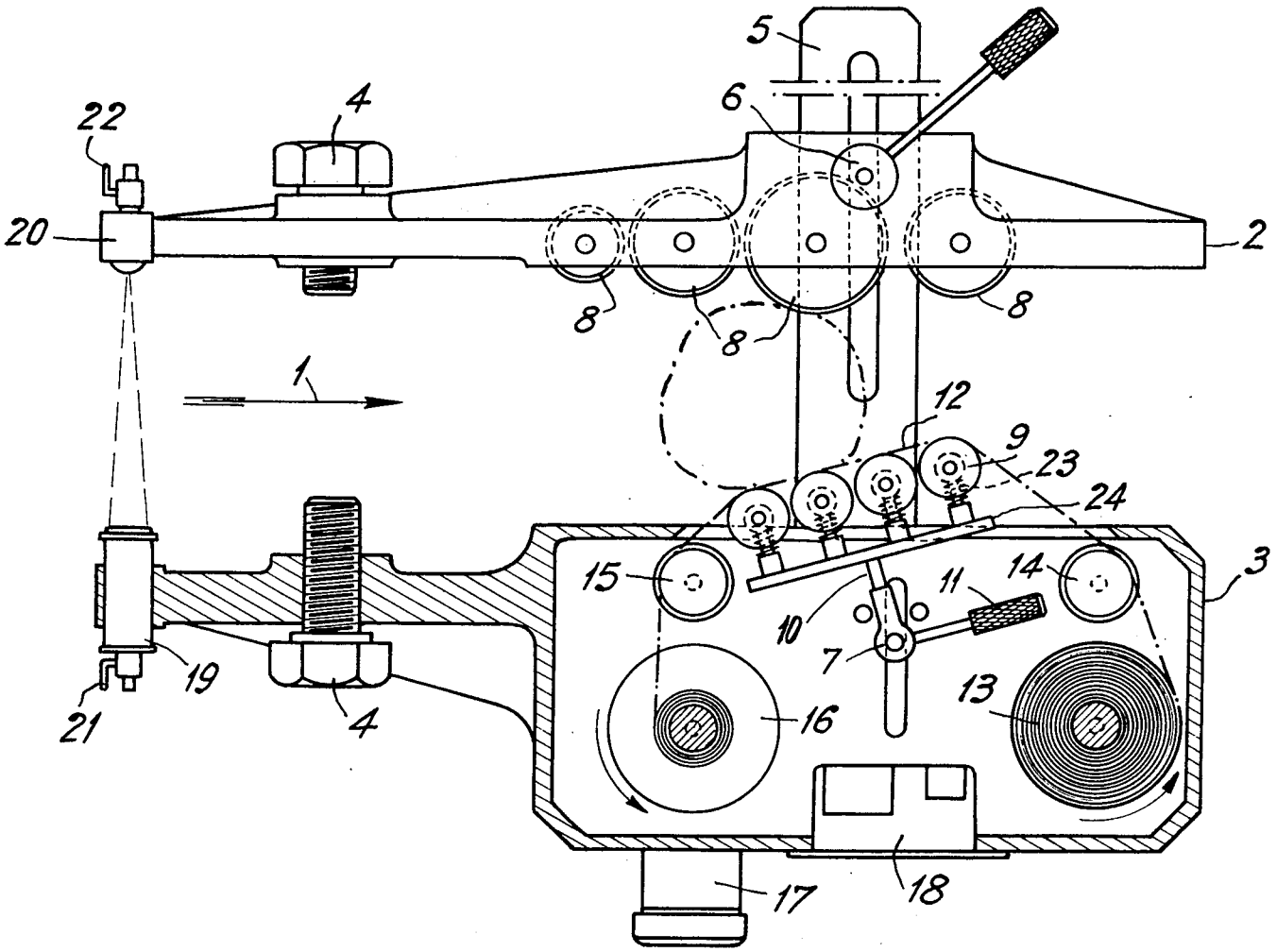
2
3
5
6
8
8
8
4
4
1
9
23
24
12
14
11
13
18
7
10
16
17
15
19
22
20
21

APPARATUS FOR THE AUTOMATIC LABELLING OF OBJECTS OF DIFFERING SHAPES

The invention relates to automatic labelling devices for objects of differing shapes, designed in particular, but not exclusively, for applying printed information onto fruits.

It is known to affix to fruits self-adhesive labels, or to print an indication of origin, or a mark, by means of an inking pad, on fruits having at least a certain degree of hardness on the outside, such as oranges.

Another solution to labelling fruit consists in wrapping the individual pieces of fruit in a piece of paper. So far these labels have been put on by hand, which considerably limits the length of the message on the one hand, and is manifestly uneconomical, taking into account cost of the labour involved, on the other hand.

Machines are known which permit fruits to be sized or weighed, and transported, after this sorting operation, into cases, crates or boxes. In these sorting and conveying machines the fruits are, in general, at some point on route, presented one by one in such a manner that they can either be individually weighed or sized.

The problem underlying the present invention is to provide an automatic labelling device which can conveniently be disposed above a conveyor belt on a part of the route where the fruits pass in a line.

The invention provides apparatus for the automatic labelling of objects of differing shapes, which comprises a first guide means, a second guide means in spaced, opposed relationship to the first guide means, means for advancing objects between the said first and second guide means, pressure contact means provided on at least one of the said first and second guide means operative to urge an object passing between the said first and second guide means against the other said second or first guide means, respectively, and means for transferring an image, by a pressure-transfer operation, to an object passing between the said first and second guide means.

The automatic labelling device, which can be conveniently mounted on a conveyor belt on which objects of differing shape having a low degree of hardness are moved along one after the other, is advantageously provided with means for pre-regulating the width between the guide means, at least one of the guide means permitting the application of a distributed pressure on the surface of the object, and means for detecting the entry of an object into the device.

The apparatus of the invention thus permits any reference to be imprinted onto the object to be labelled, which will in general be a fruit, if the afore-mentioned guide means are provided with characters or graphic designs, or labels, these latter being preferably self-adhesive labels, to be applied, to the object.

The special problem of labelling fruits arises on the one hand because these are usually of irregular shape and on the other hand because they must be handled without knocking so as to avoid bruising.

In an advantageous embodiment of the invention a support strip for labels, carried by a reel, is wound onto a receiving roller, the said strip passing over the guide means which applies a distributed pressure. In a further advantageous arrangement of the apparatus of the invention, the movement of the strip between the reel and the receiving roller is controlled by a passage detector provided at the entrance to the device. This can control the labelling process so that the part of the strip carrying a self-adhesive label arrives at the image transfer means at that moment when an object is held between these rollers and the afore-mentioned guide means.

Apparatus constructed in accordance with the invention will now be described, by way of example, with reference to the accompanying drawing, which is a plan view of a fruit labelling apparatus in partial cross-section.

With reference to the figure, the arrow 1 indicates a conveyor belt which transports the fruits from the left to the right, as seen in the drawing. The nature of the belt is such that the fruits cannot slide on it, even during the ascending or descending sections. Viewed from above, the device comprises two main parts, indicated generally by the reference numerals 2 and 3, respectively, which, after assembly of the device, are positioned one at each side of the belt.

In general, the device may be fixed to the conveying machine by any appropriate means. In the embodiment shown in the drawing, the parts 2 and 3 of the device, which are slide-mounted on a support 5 passing beneath the belt. Initially, the part 2 is locked in a slide by a handle which is integral with a rapid-action locking mechanism 6. When the width, thus determined, has been set, the final fixing of this width is effected by tightening the bolts 4.

The part 2 of the device carries rollers 8, with vertical axes, which are used to press the object or fruit against an application mechanism 9 on the part 3 of the device. For this purpose, the diameters of the first three rollers 8 increase in size so that the fruit, shown by chain dotted lines in the drawing, is shifted on the belt, irrespective of its initial position. The diameter of the fourth roller is smaller than that of the third roller so as to allow the fruit to be released after labelling.

Obviously the guide path for an apple, for example, will not be identical to that for a melon. To take account of the variation to be met with in fruits to be labelled, an application mechanism 9, comprising application rollers, is mounted so that it can slide and pivot in a slide of the support 5.

A support 10 for the application rollers 9 can oscillate about a vertically-aligned pivot 7, the position of which can be controlled by a handle 11. The desired position of the axis of the pivot 7, in the plane at right angles to it, is dependent on the average volume of the fruit to be labelled, and once this position is set it is fixed in this position for the fruit labelling session to follow.

A strip of paper 12, carrying the self-adhesive labels, is carried by a reel 13. When operations begin, the strip 12 is applied over a guide roller 14, over the application device 9, over the guide roller 15 and then threaded onto a receiving reel 16.

The rotation of the receiving reel 16 which receives the strip of paper after the labels have been transferred onto the fruits, is controlled by a motor 17, the horizontal axele of which is mechanically connected to the shaft of the reel 16 by a bevel gear, not shown.

The starting of the motor is under the control of an electronic or electro-mechanical device 18 which acts as a time-lag relay. The device 18 receives the signals transmitted by a detector comprising light source transmitter 20 and, a photo-electric cell receiver 19.

The transmitter 20 is supplied with a d.c. or a.c. voltage source by conductors 22, whilst the receiver 19 is connected by the conductors 21 to the electric relay 18.

The application rollers 9 and the guide rollers 8 are covered with foam rubber so as to avoid brusing or squashing the fruits. This covering is removable. The rollers 9 are mounted on their support 24 by way of small springs 23.

The operation of the fruit labelling device, mounted on a conveyor belt, is as follows:

The passage of a fruit along the conveyor belt 1 is detected by the cell 19–20. At the end of a period determined by the speed of the belt, the fruit arrives at the first roller 8, then the second roller 8. It is hence shifted towards the bottom of the drawing and comes into contact with the application device 9.

At this moment the motor 17 is started, on actuation by the electric relay 18, and advances the strip or ribbon 12 carrying the labels by the length separating two consecutive labels, the adhesive face of the labels being oriented towards the outside.

Under the action of the advancing movement of the fruit the springs 23 are squeezed around it and apply the label to its surface.

The fruit then continues its movement, away from the labelling device 2, 3, and the process is repeated for the next fruit.

The advancing movement of the strip 12 is not started until a certain number of seconds after the fruit has passed in front of the detector, this timelag corresponding to the time taken by the fruit to move across the distance between the detector 19 and the application device.

It is possible, of course, to have arrangements differing in detail from that described above while still keeping within the framework of the invention. For example, to trigger the feed movement of the strip 12, a microswitch placed on the first roller 8 could be used.

It is likewise possible, in a case where the labels are disposed between two strips of paper, to provide two sets of receiving rollers separating the two edges in order to apply the label to the fruit.

The first labelled by the apparatus of the invention, are now capable, by their distribution of constituting a preferred support for advertising messages or any other message.

It is obviously possible to modify the embodiments which have just been described, in particular by substituting equivalent technical means, without having to leave the framework of the present invention.

I claim:

1. Apparatus for automatically labelling objects of varying shapes conveyed for labelling to a labelling device comprising mounting means for mounting said labelling device adjacent to said conveyed objects for pivotal movement about an axis generally perpendicular to the plane of movement of said objects, and pressure contact means forming a convergent path (way) leading to said labelling device and a divergent path away from said device for urging said conveyed objects against said labelling device and releasing them after labelling.

2. Apparatus according to claim 1, including detection means for detecting the passage of an object advancing towards said labelling device, time lag relay means for transmitting a signal from said detection means to said labelling device for activating said labelling device after a predetermined time delay, said predetermined time delay being arranged to be equal to the time taken for an object to advance from the region of said detection means to the region of said labelling device.

3. Apparatus according to claim 1, in which said pressure contact means comprises a plurality of rollers spaced along the conveying path of said objects opposite from said labelling device.

4. Apparatus according to claim 3, in which at least some of said rollers are of increasing diameter proceeding along said conveying path in the direction of movement of said objects.

5. Apparatus according to claim 4, in which said rollers are of increasing diameter then decreasing diameter along said conveying path in said direction of movement.

6. Apparatus for automatically labelling objects of varying shapes conveyed for labelling to a labelling device comprising mounting means for mounting said labelling device adjacent to said conveyed objects, and pressure contact means forming a convergent path leading to said labelling device for urging said conveyed objects against said labelling device in which said mounting means mounts said labelling device for pivotal movement about an axis generally perpendicular to the plane of movement of said objects, said mounting means also mounts said labelling device for adjustable positioning toward and away from said pressure contact means, and said pressure contact means comprises a plurality of rollers spaced along the conveying path of said objects opposite from said labelling device, said rollers being of increasing diameter then decreasing diameter along said conveying path in the direction of movement of said objects along said path.

* * * * *